United States Patent [19]

Pater et al.

[11] 4,274,336

[45] Jun. 23, 1981

[54] MONORAIL GUIDEWAY ASSEMBLY

[75] Inventors: Hendrik Pater, 4154 Parkview Dr., Salt Lake City, Utah 84117; G. Earl Torgersen, Salt Lake City, Utah

[73] Assignee: Hendrik Pater, Salt Lake City, Utah

[21] Appl. No.: 932,828

[22] Filed: Aug. 11, 1978

[51] Int. Cl.[3] ..... E01B 25/08

[52] U.S. Cl. ..... 104/124; 104/118

[58] Field of Search ..... 104/118, 119, 120, 124, 104/125, 279, 247; 105/141, 144, 145; 238/131, 134, 135; 126/271.1, 271.2 A; 52/174, 263; 14/17

[56] References Cited

U.S. PATENT DOCUMENTS

| | | | |
|---|---|---|---|
| 260,550 | 7/1882 | Elliott | 104/279 |
| 532,293 | 1/1895 | Sill | 238/134 |
| 1,007,299 | 10/1911 | Lynch | 52/174 X |
| 1,561,841 | 11/1925 | Frye | 104/124 X |
| 1,709,270 | 4/1929 | Lang | 126/271.2 A |
| 2,997,965 | 8/1961 | Hawes | 104/120 |
| 3,391,652 | 7/1968 | Lauber | 104/247 |
| 3,405,650 | 10/1968 | Hawes | 104/119 |

FOREIGN PATENT DOCUMENTS

| | | | |
|---|---|---|---|
| 212249 | 11/1956 | Australia | 104/118 |
| 1063195 | 8/1959 | Fed. Rep. of Germany | 104/120 |
| 1111109 | 4/1968 | United Kingdom | 104/118 |

*Primary Examiner*—Randolph A. Reese

*Attorney, Agent, or Firm*—H. Ross Workman; Rick D. Nydegger

[57] ABSTRACT

A strong, lightweight monorail guideway assembly for carrying a monorail train vehicle in transport having selectively joined load-bearing rails which are structurally reinforceable on site in relation to support columns holding the track in suspension. Variations in stresses placed on the track are accommodated by the track structure while minimizing overall weight and material consumption. An easily accessible hollow interior provides protection and serviceability for electrical conduit placed therein. A conduit immediately adjacent the running surface may be selectively heated to inhibit icing.

18 Claims, 11 Drawing Figures

MONORAIL GUIDEWAY ASSEMBLY

BACKGROUND

1. Field of the Invention

This invention relates to lightweight continuous guideway structure for monorail trains.

2. The Prior Art

Elevated monorail trains are becoming a popular, efficient and environmentally clean method of mass transportation, and are potentially a significant factor in energy conservation. In general, tracks for monorail trains are assembled from fabricated cast concrete or rolled steel sections of uniform length, weight, and structural strength. Since the track sections are thus designed for maximum stresses along the entire length of each section, considerable excess weight in the track, which must be supported by columns, is a result. This excess weight is not only expensive but complicates transport, erection and support of the track assembly.

Cast concrete tracks are, in addition, expensive to fabricate and difficult to maintain. Generally, center grooves or troughs are cast in the top surface of concrete tracks to provide surfaces along which guide wheels of the monorail train run. These troughs accumulate water, ice, and debris and must periodically be cleaned.

Fabrication of steel track sections also presents certain problems. Due to the high coefficient of thermal expansion in steel, track sections constructed to fit between preplaced support columns often need modification on site to compensate for temperature induced expansion or contraction of the track. Electrical conduit carrying the power to run the trains is often poorly protected or inaccessible for maintenance in steel tracks as well as in concrete tracks.

In view of the foregoing problems, an improved monorail guide structure is needed which is lightweight yet strong enough to support the loads placed upon it by a monorail train. Such a track should be reinforceable on site at points of varying and increasing stress loads. The on site reinforceability should minimize the on site modification problems encountered in steel track fabrication and material consumption should be significantly reduced. A smooth ride should be derived from the surface of the track. Conduits should be protected and easily accessible for maintenance. Such an improved track assembly is disclosed herein.

BRIEF SUMMARY AND OBJECTS OF THE INVENTION

The present invention involves a guideway structure for monorail trains which is inexpensive, strong, lightweight, and selectively reinforceable on site to obtain proper fit with support columns and adequate structural strength. The track comprises smooth running and control surfaces for a comfortable ride, and a hollow interior for protection and accessibility of electrical conduits. Conduit structure adjacent to the running surfaces are constructed to conduct heat so as to inhibit icing.

It is therefore a primary object of this invention to provide an improved monorail guideway structure and method of manufacture thereof for monorail trains.

It is another object of this invention to provide an improved monorail guideway structure and method of manufacture thereof which has structural integrity and yet has reduced overall mass.

It is another object of this invention to provide an improved monorail guideway structure and method of manufacture thereof which is easily structurally reinforceable on site.

It is another object of this invention to provide an improved monorail guideway structure which presents a smooth riding surface for a monorail train.

Another object of this invention is to provide an improved monorail guideway structure in which electrical conduit is both protected and accessible.

One still further object of this invention is to provide a monorail guideway assembly selected portions of which are heated to inhibit icing of the running surfaces.

These and other objects and features of the present invention will become more fully apparent from the following description and appended claims taken in conjunction with the accompanying drawing.

DETAILED DESCRIPTION OF THE PREFERRED EMBODIMENTS

The invention is best understood by reference to the figures wherein like parts are designated with like numerals throughout.

Figure 1:
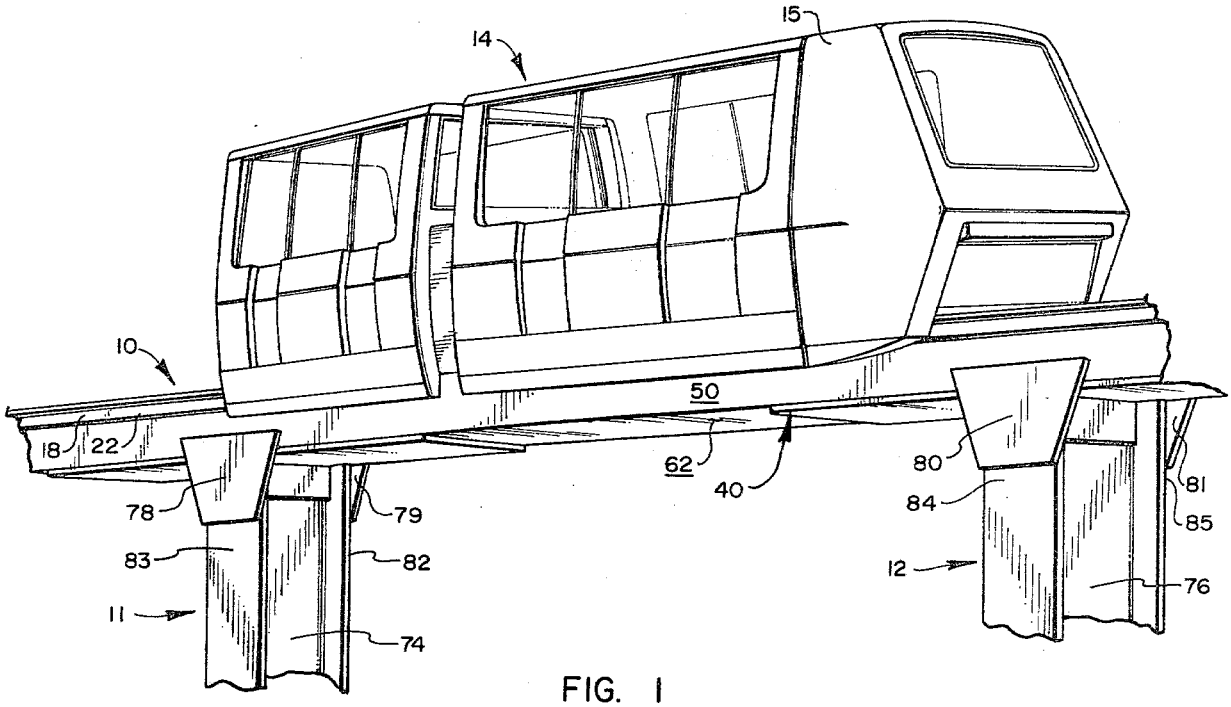
FIG. 1 is a perspective illustration of a typical monorail train situated upon the presently preferred guideway assembly embodiment of the invention, the guideway assembly embodiment being illustrated as supported upon vertical columns.
Figure 7:
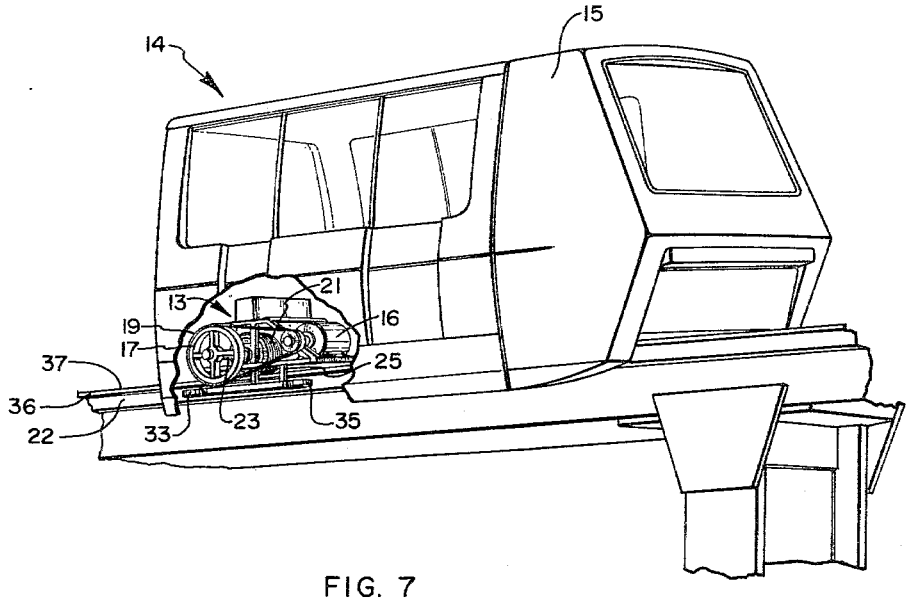
FIG. 7 is a perspective illustration of the monorail train of FIG. 1, portions being broken away to illustrate the interior drive structure supported by the monorail guideway.

FIG. 1 illustrates a preferred monorail guideway assembly embodiment generally designated 10 and mounted upon vertical support columns generally designated 11 and 12. In the illustrated embodiment, the guideway assembly 10 is shown elevated from ground level. The present invention contemplates supporting the guideway assembly 10 at the ground level, above ground level, or spanning ground supporting structure. Columns 11 and 12 typically are of steel wide flange construction having a central body members 74 and 76 and laterally extending flanges 82, 83 and 84, 85, respectively. Conventionally, the columns (e.g. 11 and 12) for supporting the guideway assembly 10 are engineered to be spaced a predetermined distance apart, depending upon site conditions, expected loads and length of track, among other things. A preferred monorail train assembly embodiment generally designated 14, is shown surmounted upon the guideway assembly in a manner hereinafter more particularly described. It is intended that the train 14 be either a plurality of vehicles coupled together as shown in FIG. 1 or a single vehicle as shown in FIG. 7. While not part of the present invention, conventional guidance and driving structure of the train 14 is briefly described and illustrated in FIG. 7 to clarify the importance of features of the guideway assembly, as will hereinafter become more fully apparent.

With continued reference to FIG. 7, bogie drive unit 13 provides power to move train 14 in transport. Portions of the train 14 have been broken away to reveal a schematic representation of the position of the bogie drive within car 15 of train 14. It should be understood that two or more similar bogies 13 would be mounted in the train car 15. Power is derived from electric motor 16, transferred to drive pulley 17 by belt 19, and received by drive wheel 21 through shaft 23. The electric motor 16 is supplied with electrical energy through a power rail (not shown) mounted conveniently upon the guideway assembly 10, the electrical energy being taken from the power rail with a conventional brush assembly (not shown). The drive wheel 21 is constructed to engage guideway assembly 10 at smooth top 37 of running surface 36 to propel train 14. Each bogie unit 13 is supported in the train car 15 by a framework 25 mounted upon the car 15. The framework also carries lateral guide wheels 33 and 35 which provide lateral guidance and stability to train 14.

Figure 2:
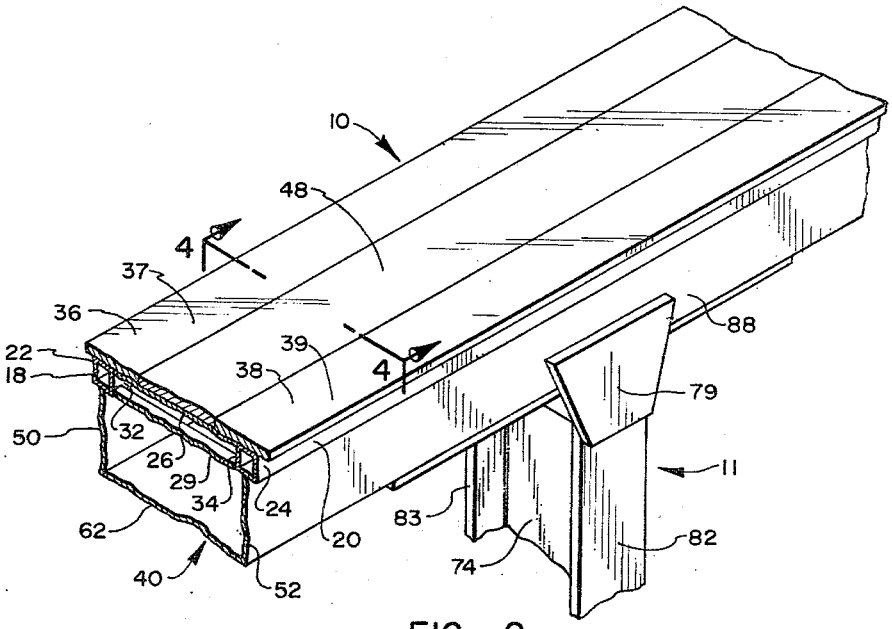
FIG. 2 is a fragmentary perspective view of the guideway assembly of FIG. 1, portions being broken away to reveal inner parts.
Figure 3:
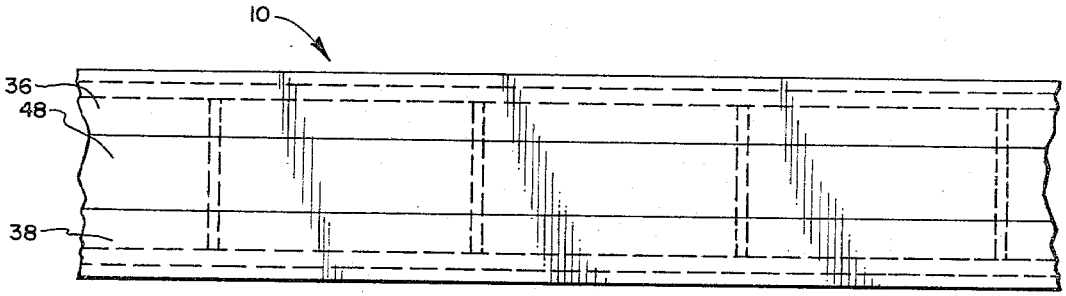
FIG. 3 is a top plan view of a portion of the guideway assembly.
Figure 4:
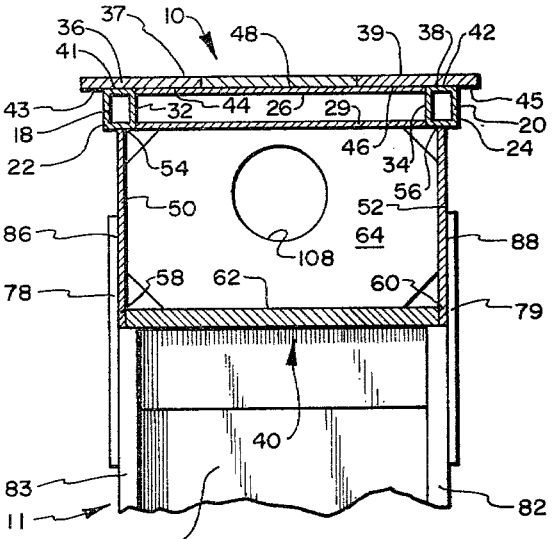
FIG. 4 is a cross-sectional view taken along lines 4—4 of FIG. 2.

The structure of the guideway assembly 10 can best be understood by reference to FIGS. 2–6. Referring more particularly to FIGS. 2 and 4, the present embodiment of the guideway assembly 10 is illustrated as having three principal components, namely, running surfaces 36 and 38, beams 18 and 20, and truss 40. Running surfaces 36 and 38 are preferably constructed of plate steel in the form of laterally spaced, essentially continuous, elongated tracks. Running surfaces 36 and 38 are normally coplanar and parallel when the track assembly is linear. Each running surface 36 and 38 provides correspondingly smooth top faces 37 and 39 over which drive wheels, e.g. drive wheel 21 (shown in FIG. 7) traverse. Typically, running surfaces made of 3/8 inch plate steel have proven to be an adequate compromise between strength and weight. The comparatively smooth running surfaces permit the drive wheels of the train 14 to traverse the track assembly quietly and safely.

Figure 9:
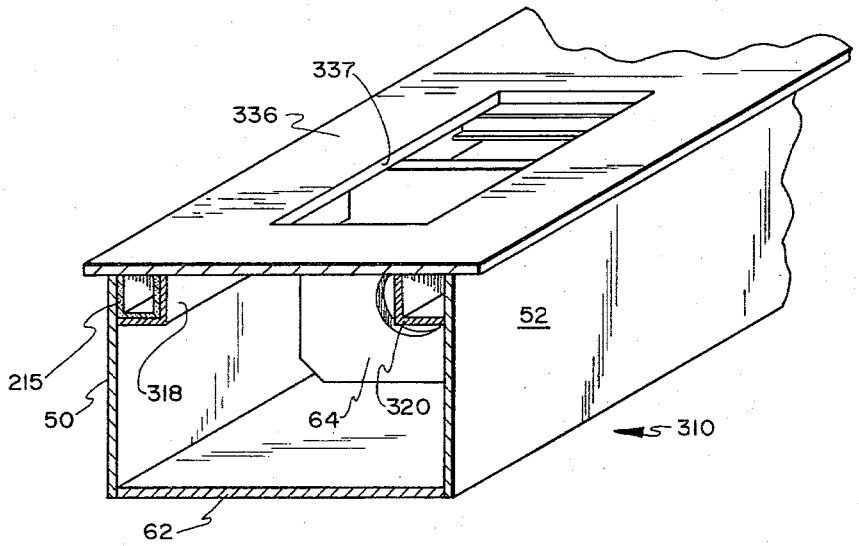
FIGS. 9 and 10 are fragmentary perspective illustrations of other suitable guideway embodiments.
Figure 10:
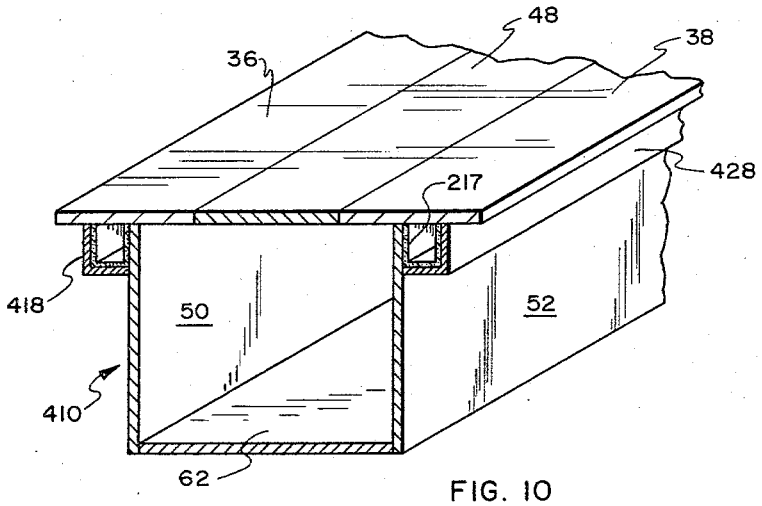

Running surfaces 36 and 38 are rigidly mounted upon corresponding parallel support members or beams 18 and 20. Beams 18 and 20 are coextensive with running surfaces 36 and 38 and give structural support thereto. Beams 18 and 20 are of hollow, tubular construction. Uniquely the tubular construction contributes remarkable structural strength while simultaneously minimizing overall weight. The beams 18 and 20, in the embodiment illustrated in FIGS. 1–6, are square or rectangular in cross section and, therefore, may be conveniently fabricated according to conventional cold-rolling processes. Alternative constructions of beams 18 and 20 are illustrated in FIGS. 9 and 10, as will be hereinafter more fully described.

Figure 5:
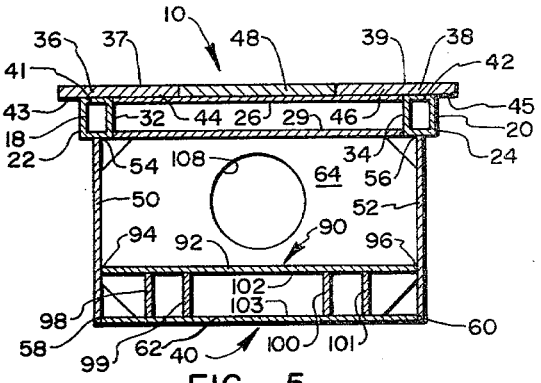
FIG. 5 illustrates another presently preferred guideway assembly embodiment particularly illustrating reinforcement structure.
Figure 6:
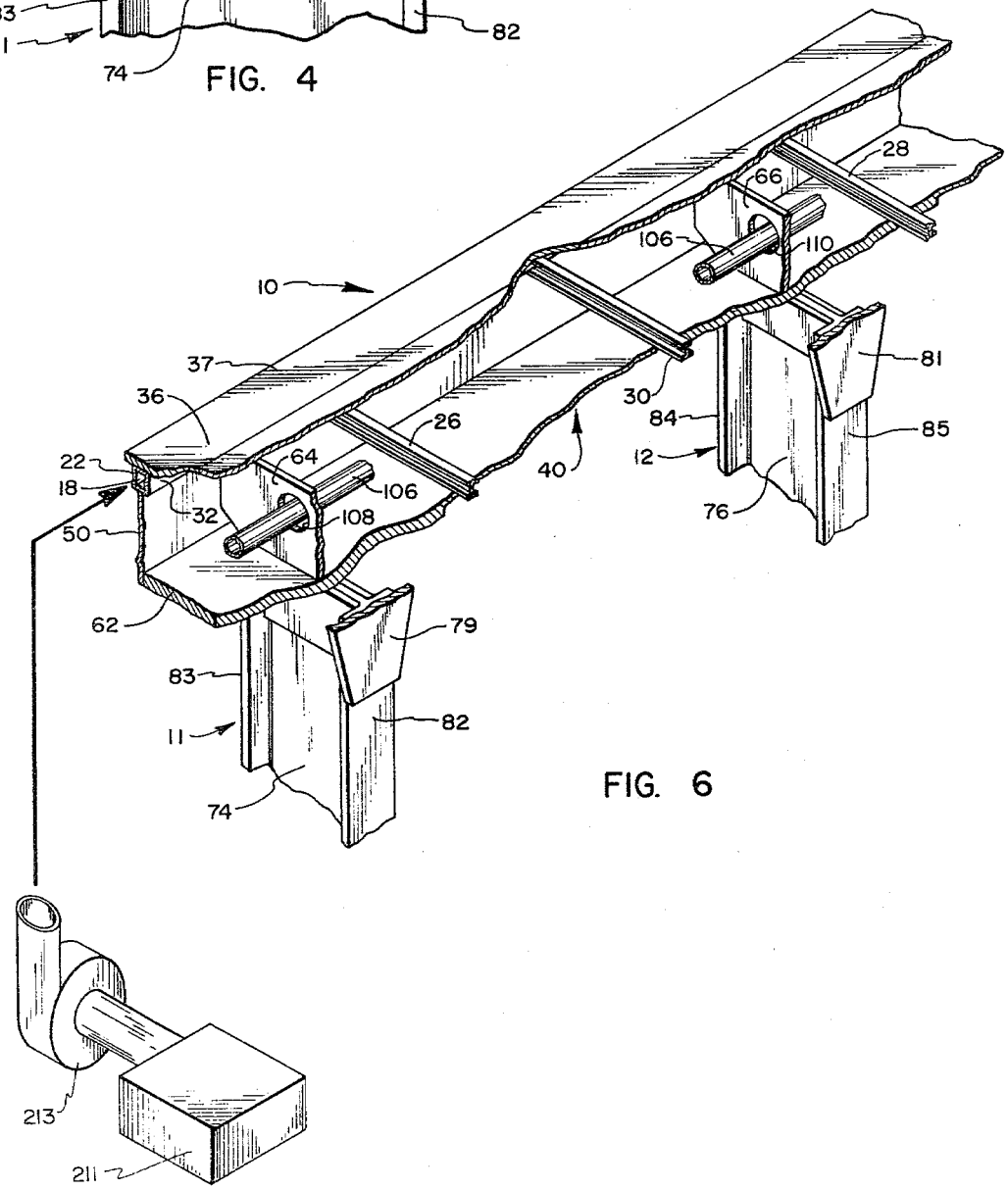
FIG. 6 is a fragmentary perspective illustration of the guideway assembly with portions broken away to reveal interior construction parts of the guideway deicing structure being illustrated schmatically.

As shown best in FIGS. 4 and 5, the flat upper sides 41 and 42 of each beam 18 and 20 are surmounted by the respective running surfaces 36 and 38. Typically the running surfaces are welded or otherwise suitably permanently joined to the beams. It is pointed out that the beams 18 and 20 are inset from the exterior edges of the rails 36 and 38 so as to define rail overhangs 43 and 45. The exterior sides 22 and 24 of the beams 18 and 20 are essentially perpendicular to the plane of the running surfaces 36 and 38. Sides 22 and 24 define the control surfaces over which lateral guide wheels, e.g. guide wheels 33 and 35 (see FIG. 7) traverse. Thus, control surfaces 22 and 24 permit the guide wheels to guide and stabilize the train 14.

The spacing between the beams 18 and 20 is maintained by a plurality of tie bars 26, 28 and 30 which are welded or otherwise suitably secured between beams 18 and 20 at the interior sides 32 and 34. The tie bars e.g. 26, 28 and 30 are of I-beam or wide flange construction and (as shown best in FIG. 6) each is spaced from the next. Although any suitable spacing could be used, in one preferred embodiment, the tie bars 26, 28 and 30 are located approximately 7 feet apart along the length of the track 10.

It is pointed out that the transverse width of the beams 18 and 20 is less than the width of the running surfaces 36 and 38. Thus, in addition to the exterior overhangs 43 and 45, running surfaces 36 and 38 also define interior overhangs 44 and 46 (see especially FIGS. 4 and 5). The interior overhangs 44 and 46 normally engage the upper tie bars 26, 28 and 30 along the margin thereof.

Running surfaces 36 and 38 and the underlying beams 18 and 20, respectively, are structurally supported by truss 40. The truss 40 is shown as rectangular in cross section although circular or other suitable configurations could be used. In the illustrated embodiment, truss 40 has side flanges 50 and 52 mounted rigidly to the flat bottom surfaces 54 and 56 of the corresponding beams 18 and 20. The flanges 50 and 52 are normally oriented essentially in the vertical plane and extend downwardly perpendicular to the bottom surfaces 54 and 56 of the beams 18 and 20. In a preferred embodiment, flanges 50 and 52 were constructed of steel plate.

A bottom wall plate 62 is joined between the flanges 50 and 52 at corresponding bottom ends 58 and 60 in the generally horizontal plane. The bottom wall 62 preferably traverses the length of the track 10. Importantly, it has been found highly desirable to construct bottom wall plate 62 of variable thickness, for example, ranging in thickness between ⅜ inch (approximately 0.95 cm) and one inch (approximately 2.54 cm) or more. The use of variable plate thickness for the bottom wall plate 62 has been found to be advantageous to withstand the compressive stresses which are more pronounced at the locations where the truss 40 is supported upon the columns 11 and 12. The spacing between the thicker portions and thinner portions (see FIG. 6) is selected to correspond approximately to the expected spacing between columns 11 and 12. The thicker portions are formed to traverse about 20% to 30% of the span length of the guideway section.

Alternatively, the structure illustrated best in FIG. 5 could be used to reinforce the bottom plate 62. As shown in FIG. 5, a support framework generally designated 90 has a horizontal plate 92 which is welded or otherwise suitably attached to the inside surfaces 94 and 96 of flanges 50 and 52. Vertical spacer plates 98–101 are secured to the bottom surface 102 of the horizontal plate 92 and to the top surface 103 of the bottom wall plate 62. The location of the framework 90 is selected to coincide with the location of support column 11 or 12. If desired, the framework 90 can be installed in the proper location when the track assembly 10 is on the construction site.

Flanges 50 and 52 cooperate with bottom wall 62 to define a hollow interior within the track assembly 10 below beams 18 and 20 and running surfaces 36 and 38. Thus, in addition to providing a more lightweight assembly, the interior may be used to contain electrical conduit 106 or the like.

Historically, a problem of substantial significance in the assembly of monorail guideways has been to locate reinforced portions of the guideway immediately over the previously spaced columns, e.g. columns 11 and 12. When guideway assemblies are fabricated in a fabrication plant, and thereafter removed to the construction site, the length of the guideway assembly may vary substantially depending upon the temperature at the construction site. For example, the temperature of the guideway assembly can vary as much as 100° F. to 140° F. from point of fabrication to the installation site. It will be appreciated, therefore, that the guideway assembly reinforced at predetermined locations in the fabrication plant and later removed to the construction site may undergo a change of length which would remove the reinforced portions substantially out of reigster with pre-established support column positions.

One of the significant advantages of the present invention is the ability to locate reinforcement structure at the construction site. With continued reference to FIGS. 4, 5 and 6, it will be observed that diaphragm plates 64 and 66 are welded or otherwise suitably secured within the interior of the truss 40 in the generally vertical plane essentially perpendicular to flanges 50 and 52 and bottom wall 62. At the installation site, the diaphragm plates 64 and 66 may be welded in position immediately above the corresponding support columns 11 and 12 where the most significant shear stresses occur.

In assembly, the precise location of engagement of the column to the truss 40 is ascertained at the installation site. Thereafter, the diaphragm 64 is oriented so as to fit between rails 36 and 38. Diaphragm 64 is then positioned into the transverse position illustrated in FIGS. 4–6 at the location of the column 11 or 12. The diaphragm is then welded in place. In the illustrated embodiment, the corners of the diaphragm plate have been removed for ease of on site installation and to permit displacement along the guideway of any moisture accumulating in truss 40. Thus, the location and physical characteristics of each diaphragm plate 64 or 66 can be selected to give the required structural integrity to the track assembly at the location of the support columns 11 or 12.

In order to advantageously utilize the interior of the track assembly 10 for concealing conduit 106 and the like, apertures 108 and 110 are desirably formed in the diaphragms 64 and 66, respectively. A cover plate 48 (FIGS. 2, 4 and 5) is constructed to nest between running surfaces 36 and 38 and normally is welded to surfaces 37 and 39 with specified areas bolted in place rather than welded. The bolted cover plates 48 may be easily removed from time to time by lifting the plate upwards away from the tie bars 26–28, thereby permitting access to the interior of the guideway assembly 10 and the conduit 106 therein.

Normally, the guideway assembly 10 is fabricated at a fabrication plant remote from the installation site. In the course of fabrication, however, diaphragms 64 and 66 are fabricated but not installed within the truss 40. The guideway assembly is then transported in suitable lengths to the installation site where the location of columns 11 and 12 has been predetermined. During installation, the guideway assembly 10 is lifted upon the columns 11 and 12 (see FIGS. 1, 2 and 6). The thicker portions of the bottom plate 62 have been preconstructed so as to be essentially coincident with the expected placement of columns 11 and 12. Alternatively, the reinforcement structure illustrated in FIG. 5 and described above could be utilized to reinforce the bottom plate 62 at the location of the columns 11 and 12.

As soon as the point of engagement of the columns 11 and 12 with the bottom 62 of the guideway assembly 10 has been ascertained, diaphragms 64 and 66 may be secured in place immediately above the corresponding columns. The guideway assembly 10 is then permanently attached to the columns 11 and 12 by securing end plates 78–81 between the columns and corresponding portions of the truss 40. For example, referring particularly to FIGS. 2 and 4, it is observed that the lateral flanges 82 and 83 of the beam 11 are flush with the sides 52 and 50 of the truss 40. Accordingly, end plate 78 can be welded or otherwise suitably rigidly mounted to both the truss and the lateral side 83 to secure the track assembly 10 to the column 11. The end plate 79 is similarly secured to the lateral end 82 and side 52.

Figure 8:
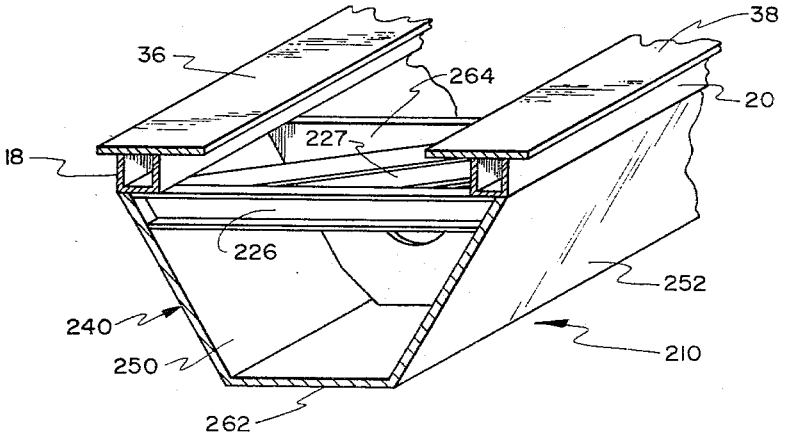
FIG. 8 is a fragmentary perspective view of still another guideway embodiment of the present invention.

Referring now to FIG. 8, another presently preferred guideway assembly generally designated 210 is illustrated. The guideway assembly 210 is similar to guideway assembly 10 in some respect. Running surfaces 36 and 38 are mounted on beams 18 and 20 as heretofore described. Guideway assembly 210 is, however, of "open" construction such that the interior of the truss generally designated 240 is always open at the top. The truss 240 includes sides 250 and 252 which slope inwardly. Sides 250 and 252 are joined to the bottom 262, bottom 262 having a thickness which is variable as described in connection with bottom 62 illustrated in FIGS. 1–6.

The sides 250 and 252 are strengthened and spaced by a plurality of support beams, only one support beam, i.e. being 226 being illustrated in FIG. 8. Support beam 226 is welded or otherwise suitable mounted between the sides 250 and 252 and is preferably configurated as a wide flange structural member. A transverse diaphragm 264 serves substantially the same function as diaphragm 64 and 66 described above. If desired, a cross-brace 227 may be utilized between the support member 226 and the diaphragm 264 to strengthen the construction. Additional cross-braces (not shown) may desirably be used between selected one of the additional support members which are similar to support member 226.

Reference is now made to the guideway assembly embodiment of FIG. 9 which is similar to the guideway assembly embodiment 10 illustrated in FIGS. 1–6 excepting the construction of the running surface and corresponding beams. More particularly, the guideway assembly 310 has a running surface 336 which is a single unitary steel plate superimposed over the sides 50 and 52. The running surface 336 is reinforced to the sides 50 and 52 with corresponding angle iron braces 318 and 320 which are welded or otherwise suitably secured to the corresponding sides 50 and 52. Angle iron 318, when joined to the side 50, cooperates with the side 50 and the running surface 36 to form a hollow structural beam which gives structural integrity to the guideway assembly 310. Angle iron 320 is similarly structurally related to side 52 and running surface 336. Clearly, diaphragm 64 would be configurated to nest around the beams 318 and 320.

While the running surface 336 may be one continuous uninterrupted plate, in the embodiment illustrated in FIG. 9, segments of the plates have been removed to permit access to the interior of the guideway assembly 310 for maintenance, assembly and the like. The opening 337 thus formed is preferably situated around suitable support members 26, 28 and 30 (see FIG. 6) or over a suitable diaphragm 64 such that a cover plate (not shown) may be nested within the opening 337, when desired.

Reference is now made to the guideway assembly embodiment 410 illustrated in FIG. 10. The guideway embodiment 410 is substantially the same as the guideway embodiment 10 illustrated in FIGS. 1–6 except with respect to the relationship between the beams and the running surfaces as will now be described. In the embodiment of FIG. 10, the running surfaces 36 and 38 are mounted directly upon the sides 50 and 52, respectively. The running surfaces 36 and 38 are supported in this position by angle iron braces 418 and 420 which cooperate with the corresponding sides 50 and 52 to form structural beams. The structural beams are hollow and are closed at the top by the running surfaces 36 and 38, respectively. Accordingly, the beams illustrated in FIG. 10 are substantially the same as the beams illustrated in FIG. 9 except that in FIG. 10 the beams are located on the exterior sides of 50 and 52.

Figure 11:
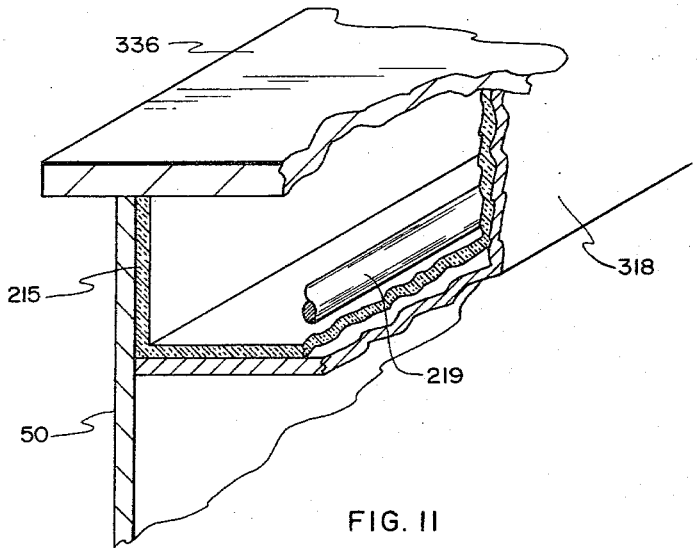
FIG. 11 schematically illustrates alternative structure for deicing the guideway.

The hollow beams 18 illustrated in FIGS. 1–8 and the corresponding structure illustrated in FIGS. 9–11, in addition to the significant benefits of providing structural strength, ease of assembly and comparative light weight also, in accordance with the present invention, function as conduits which facilitate deicing of the steel guideway. More particular, with reference to FIG. 6, a source of heated air represented schematically at 211 is communicated through a conventional air blower 213 to the interior of the beam 18. In actual construction, a resistance heater and plenum chamber may be mounted at or near columns 11 and 12 and heated air forced by a blower 213 through ducts (not shown) to the interior of the beam 18. The hot air forced through the beam 18 maintains the running surfaces 36 and 38 in a deiced condition by conducting the heat directly to the running surfaces.

Greater efficiency in deicing the running surfaces 36 and 38 can be obtained by insulating the interior of the beam 18 on every surface except that contiguous with the running surface 36. In this regard, attention is directed particularly to FIGS. 9 and 10. In FIG. 9, strip insulation 215 is adhered to the inside surface of angle brace 318 and also on a portion of the side wall 50. No insulation is provided underneath the running surface 336. Accordingly, heated air conducted through the beam defined by angle brace 318 will be conducted principally to the running surface 336 thereby maintaining the running surface 336 in a de-iced condition. Alternatively, as shown in FIG. 10, spray foam 217 may be placed in the angle brace 428 prior to assembly and also on a portion of the side wall 52 prior to assembly so as to assure that heat conducted through the beam defined by the angle brace 428 will be directed to the running surface 38.

Another preferred deicing embodiment is illustrated in FIG. 11. The embodiment of FIG. 11 is a modification of the guideway assembly FIG. 9, the modification being primarily in the mode of heating. In FIG. 11, an elongated resistance element 219 traverses the inside of the beam created by angle bracket 318.

Resistance element 219 is situated along the length of the beam defined by angle bracket 318. The insulation 215 is placed as described above so that heat developed by the resistance element 219 will radiate directly to the underside of running surface 336. Because the beam defined by angle bracket 318 opens directly to the underside of running surface 336, the running surface will be heated and maintained in a deiced condition. The resistance element 219 is energized by conventional source of electrical power (not shown) in a manner well known to those skilled in the art.

The guideway assembly described above is aesthetic in appearance and retains a surprising degree of structural integrity thereby providing a safe and effective monorail track. At the same time, the track assembly is comparatively light in weight and simple and inexpensive to install.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A monorail guideway assembly supported upon at least one column, the guideway assembly comprising:
   at least one running surface;
   a truss assembly joined to and supporting the running surface, said truss assembly defining a hollow channel beneath the running surface; and
   the bottom of said truss assembly at locations immediately adjacent to the at least one support column, comprising a size which exceeds the size of the bottom of the truss at locations between the support columns, so that the variation in stresses applied to the running surface is compensated for while minimizing overall weight.

2. A monorail guideway assembly as defined in claim 1 wherein said truss assembly is rectangular in cross section and further comprising spaced generally tubular beams interposed between the truss assembly and the running surface, said beams presenting at least one laterally projecting control surface, said truss assembly further comprising transverse tie means.

3. A monorail guideway assembly as defined in claim 2 wherein said beams have a rectangular tubular cross section.

4. A monorail guideway assembly as defined in claim 2 wherein an angle bracket cooperates with the truss assembly to form the tubular beams.

5. A monorail guideway assembly as defined in claim 1 wherein said truss assembly is supplemented with a framework for improving structural integrity at the location of column support.

6. A monorail guideway assembly as defined in claim 1 further comprising structural support means separately fabricated such that said support means may be selectively, permanently and rigidly attachable to the truss assembly in the regions of column support once the exact locations of column support are known relative to the truss assembly, thereby improving structural integrity at the location of column support.

7. A monorail guideway assembly as defined in claim 1 wherein said structural support means comprise a diaphragm means configured so as to be selectively attachable with the hollow channel in the regions of column support.

8. A monorail guideway assembly as defined in claim 7 wherein said diaphragm means comprise an aperture for permitting electrical conduit to pass therethrough.

9. A monorail guideway construction supported upon at least one column comprising:

at least two elongated laterally spaced and generally parallel support members, at least one side of each support member comprising a control surface;

means joining the parallel support members one to the other at spaced, predetermined locations;

means mounted upon each support member such that the said means define parallel running surfaces along the length of the monorail guideway construction, the width of said parallel running surfaces extending outwardly from the said parallel support members;

means mounted below said parallel support members comprising a truss defining a hollow beneath the support members which hollow opens at the top between the parallel running surfaces;

diaphragm means which are selectively attached to the truss in the regions of column support once the exact locations of column support are known relative to the truss, thereby improving the structural integrity at the locations of column support; and the bottom of said truss at locations immediately adjacent to the at least one support column, comprising a size which exceeds the size of the bottom of the truss at locations between the support columns, so that the variation in stresses applied to the running surfaces are compensated for while minimizing overall weight.

10. A monorail guideway assembly as defined in claim 9 further comprising an elongated cover plate adapted to nest between the spaced parallel running surfaces and to close at least a portion of the top of the hollow channel beneath the spaced running surfaces.

11. A monorail guideway construction as defined in claim 9 wherein the parallel support members are of hollow tubular construction and rectangular in cross section.

12. A monorail guideway construction as defined in claim 11 further comprising means for heating the hollow interior of the support members.

13. A monorail guideway construction as defined in claim 12 wherein said hollow parallel support members are insulated to direct the heat therein primarily toward the running surfaces.

14. A monorail guideway construction as defined in claim 9 wherein said parallel running surfaces are unitedly joined together as a single elongated plate.

15. A monorail guideway assembly which is suspendible upon support columns for supporting a train having drive wheels and control wheels, the track assembly comprising:

at least two elongated laterally spaced and generally parallel support members of hollow tubular construction, rectangular in cross section, the outer sides of said support members comprising a control surface providing a running surface for at least one lateral control wheel;

means joining the parallel support members one to the other at spaced, predetermined locations, said joining means comprising tie bars connecting the inner sides of said parallel support members;

running surface means mounted upon each parallel support member at the top thereof in the generally horizontal plane such that said running surface means define spaced parallel rails, said rails supporting the load carrying drive wheels of the vehicle along the length of the monorail guideway assembly, the width of said rails extending beyond the inner and outer sides of the parallel support members;

means comprising a removable cover plate placed between said rails and resting upon the means joining the parallel support members;

truss means mounted below the parallel support members and comprising a flange attached to the lower sides of each of the parallel support members and extending downwardly, and means joining said flanges of the truss, said truss, running surface means and support members cooperating to define a hollow interior of the guideway assembly;

means mounted inside the truss comprising a diaphragm plate attached to the inside surfaces of the flanges and bottom of said truss above the support columns, said diaphragm plates comprising an aperture through which conduit may pass; and the bottom of said truss, at locations immediately adjacent to the support columns comprising a size which exceeds the size of the bottom of the truss at locations between the support columns, so that the variation in stresses applied to the track are compensated for while minimizing overall weight.

16. A monorail guideway construction as defined in claim 15 for the comprising means for delivering heated air through the hollow support members.

17. A monorail guideway construction as defined in claim 15 for the comprising resistance heating means situated within the hollow support members and means for selectively energizing the resistance heating means.

18. A monorail guideway construction as defined in claim 15 wherein said hollow support members are provided with insulation over selected surfaces thereof.

* * * * *